US005153115A

United States Patent [19]

Yasunami et al.

[11] Patent Number: 5,153,115

[45] Date of Patent: Oct. 6, 1992

[54] SILVER HALIDE PHOTOGRAPHIC MATERIALS AND METHOD FOR MANUFACTURE THEREOF

[75] Inventors: Shoichiro Yasunami; Yasuo Mukunoki, both of Kanagawa, Japan

[73] Assignee: Fuji Photo Film Co., Ltd., Kanagawa, Japan

[21] Appl. No.: 742,497

[22] Filed: Aug. 5, 1991

Related U.S. Application Data

[63] Continuation of Ser. No. 534,902, Jun. 8, 1990, abandoned.

[30] Foreign Application Priority Data

Jun. 9, 1989 [JP] Japan ..... 1-147651

[51] Int. Cl.[5] ..... G03C 1/76

[52] U.S. Cl. ..... 430/527; 430/523; 430/525; 430/529; 430/530; 430/531; 430/536; 430/627

[58] Field of Search ..... 430/527, 529, 530, 531, 430/536, 627, 523, 525

[56] References Cited

U.S. PATENT DOCUMENTS

| | | | |
|---|---|---|---|
| 2,593,888 | 4/1952 | Jones | 430/627 |
| 3,549,375 | 12/1970 | Pechmann . | |
| 4,225,665 | 12/1978 | Schadt, III | 430/529 |
| 4,358,533 | 11/1982 | Tokitou et al. | 430/527 |
| 4,605,612 | 8/1986 | Asao et al. | 430/538 |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

Silver halide photographic materials are disclosed, comprising a support having thereon at least one photosensitive silver halide emulsion layer, wherein at least one layer of said photographic material is formed by polymerizing a film which contains a compound represented by formula (I):

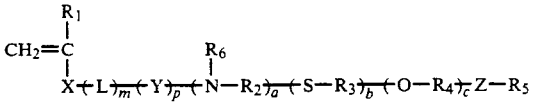

(I)

wherein X represents —CO—, —COO—,

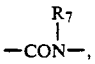

—OCO— or an arylene group; L represents an alkylene group, an aralkylene group or an arylene group, any of which can optionally have substituents; Y represents —CO—, —$SO_2$— or —NHCO—; m and p each independently represents 0 to 1, provided that when X is

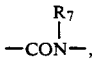

m is 1; Z represents —O—, —S— or

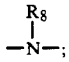

$R_1$ represents a hydrogen atom, an alkyl group, a halogen atom or a cyano group; $R_2$, $R_3$ and $R_4$ represent lower alkylene groups; $R_5$ represents a hydrogen atom, an alkyl group, an alkenyl group, an aryl group, an aralkyl group, —CO—$R_9$ or —$SO_2R_9$, any of which, other than a hydrogen atom, can optionally have substituents; $R_6$, $R_7$ and $R_8$ represent hydrogen atoms, alkyl groups or alkenyl groups, any of which, other than hydrogen atoms, can optionally have substituents; $R_9$ represents an alkyl group, an alkenyl group, an aryl group or an aralkyl group, any of which can optionally have substituents; and a, b and c each independently represents an integer of value from 0 to 30, and a, b and c are not all equal to 0.

8 Claims, No Drawings

SILVER HALIDE PHOTOGRAPHIC MATERIALS AND METHOD FOR MANUFACTURE THEREOF

This is a continuation of application Ser. No. 07/534,902 filed Jun. 8, 1990, now abandoned.

FIELD OF THE INVENTION

The present invention concerns silver halide photographic materials which have good antistatic properties. In particular, it concerns silver halide photographic materials (referred to hereinafter as photographic materials) which have been rendered antistatic in such a way that no image unevenness arises during development processing and also without adversely affecting the coating properties of th photographic materials. Additionally, no contamination of the development processing baths (i.e., the developing bath) occurs when the photographic materials of the present invention are processed in an automatic processor.

BACKGROUND OF THE INVENTION

Photographic materials are generally comprised of a support which has electrical insulating properties and a photographic layer. In many cases, electrostatic charges build up as a result of contact friction with, or separation from, a surface of a material of the same or different type during the manufacturing processes or use of the photographic material. The accumulated electrostatic charge causes considerable damage to the photographic material. Most importantly, the accumulated electrostatic charge causes imperfection marks such as spots or tree-like or feather-like lines to appear when the photographic film is developed. These marks result from the photosensitive emulsion layer having been inadvertently exposed due to the discharge of the accumulated electrostatic charge prior to development processing. Such marks are usually referred to as static marks, and the commercial value of the photographic film is reduced to a considerable degree due to their presence and, depending on the particular case, the commercial value may be lost completely. The static marking phenomenon first becomes apparent upon development of the photographic film, and it is a very troublesome problem. Furthermore, these electrostatic charges can result in dust becoming attached to the surface of the film either before or after processing. Also, electrostatic charges can cause other secondary problems such as an inability to provide uniform coating.

The static marks on photographic materials, which are caused by such build up of static charge, become more pronounced when the photographic speed of the photosensitive material is increased and/or when the processing rate is increased. Static mark formation has become more likely to occur recently because of the increased photographic speeds of photographic materials and as a result of the more severe handling of the material such as during high speed coating, high speed camera operation and high speed automatic development processing. Moreover, the opportunities for handling processed photographic materials have increased in recent years and the attachment of dust has become a serious problem.

The addition of antistatic agents to a photographic material is desirable for preventing the occurrence of these problems due to static electricity. However, the antistatic agents which are used generally in other fields cannot be used without modification of the photographic materials because various specific limitations must be imposed when antistatic agents are used in photographic materials. That is to say, in addition to having excellent antistatic performance, the antistatic agents which can be used in photographic materials must not cause an adverse effect on the photographic performance. For example, the antistatic agents cannot cause an adverse effect on photographic properties such as the photographic speed, fog level, graininess and sharpness, of the photosensitive material, and the film strength or the antistick properties of the photosensitive material. Further, the antistatic agents must not increase the rate at which the developing baths for the photographic materials become fatigued, and they must not contaminate transporting rollers. Also, the antistatic agents must not reduce the strength of adhesion between the various structural layers of the photographic material. Thus, a great many limitations are imposed on antistatic agents for use in photographic materials.

One way of preventing the occurrence of problems due to static electricity is to render the surface of the photographic material electrically conductive so that the electrostatic charge is dispersed quickly before a charge can build up and discharge.

Other methods of increasing the electrical conductivity of the supports and the various coated surface layers of photographic materials have been considered in the past which include attempts to make use of various hygroscopic substances and water-soluble inorganic salts, and, for example, certain types of surfactant and polymers.

Among these materials, the surfactants are important from the point of view of antistatic performance, and these include the anionic, betaine and cationic surfactants disclosed, for example, in U.S. Pat. Nos. 3,082,123, 3,201,251, 3,519,561 and 3,625,695, West German Pat. Nos. 1,552,408 and 1,597,472, JP-A Nos. 49-85826, 53-129623, 54-159223, 48-19213, JP-B Nos. 46-39312, 49-11567, 51-46755 and 55-14417, and the nonionic surfactants disclosed, for example, in JP-B No. 48-17882, JP-A No. 52-80023, West German Patent Nos. 1,422,809 and 1,422,818, and Australian Patent No. 54,441/1959 (the terms "JP-A" and "JP-B" as used herein refer to a "published unexamined Japanese patent application" and an "examined Japanese patent publication", respectively).

However, these substances exhibit specificity according to the type of film support and differences in photographic composition and the performance aforementioned is not satisfactory. Further, it is very difficult to make use of these materials in photographic materials in practice.

Furthermore, the ethylene oxide adducts of phenol/formaldehyde condensates disclosed in JP-B No. 51-9610 have been shown to have excellent antistatic performance when used conjointly with various coating agents. However, the problems due to contamination in the development processing are not resolved with this method.

Furthermore, photographic materials which contain specified anionic surfactants and polyoxyethylene based nonionic surfactants have been disclosed in JP-A No. 53-29715, but no improvement is obtained with respect to film damage due to contamination of the development processing baths and contamination of transporting rollers.

Moreover, photographic materials which contain polyphosphazene compounds have been disclosed in JP-A No. 64-68751, but the aforementioned problems can still not be overcome even with these compounds.

Furthermore, photographic materials which contain polyacrylic based esters or amides which have polyoxyethylene groups in side chains have been disclosed in JP-A No. 63-223638 and JP-B No. 1-18408, but the antistatic performance is still inadequate and they cannot be applied to photographic materials.

Methods of processing in which the amount of water used is reduced have been used in recent years with a view to protecting the environment and economizing on water resources, as well as from the point of view of cost and for the provision of more compact processing machines. Methods in which the rate of replenishment is reduced have been used from the point of view of cost, and attempts have also been made to increase the concentrations of processing baths with a view to shortening processing times. However, increased processing bath contamination and pronounced image unevenness have become serious problems with the development of such processing methods.

SUMMARY OF THE INVENTION

The first object of the present invention is to provide photographic materials which have been rendered antistatic and which do not give rise to developing bath contamination.

The second object of the present invention is to provide photographic materials which have been rendered antistatic in such a way that no image unevenness arises during development processing.

The third object of the present invention is to provide photographic materials which have been rendered antistatic without adverse effect on the coating properties.

These objects have been realized by means of:

A silver halide photographic material comprising a support having thereon at least one photosensitive silver halide emulsion layer, wherein at least one layer of the photographic material is formed by polymerizing a coated film which contains a compound represented by formula (I):

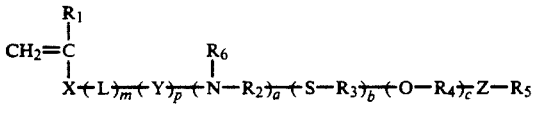

(I)

wherein X represents —CO—, —COO—,

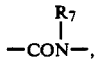

—OCO— or an arylene group; L represents an alkylene group, an aralkylene group or an arylene group, any of which can optionally have substituents; Y represents —CO—, —$SO_2$— or —NHCO—; m and p each independently represents 0 or 1, provided that when X is

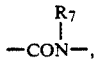

m is 1; Z represents —O—, —S— or

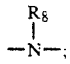

$R_1$ represents a hydrogen atom, an alkyl group, a halogen atom or a cyano group; $R_2$, $R_3$ and $R_4$ represent lower alkylene groups; $R_5$ represents a hydrogen atom, an alkyl group, an alkenyl group, an aryl group, an aralkyl group, —CO—$R_9$ or —$SO_2R_9$, any of which, other than a hydrogen atom, can optionally have substituents $R_6$, $R_7$ and $R_8$ represent hydrogen atoms, alkyl groups or alkenyl groups, any of which, other than hydrogen atoms, can optionally have substituents; $R_9$ represents an alkyl group, an alkenyl group, an aryl group or an aralkyl group, any of which can optionally have substituents; and a, b and c each independently represents an integer of value from 0 to 30, and a, b and c are not all equal to 0.

Further, preferably the silver halide photographic material comprises a support having thereon at least one photosensitive silver halide emulsion layer, wherein at least a polymer of a compound represented by formula (I) and the salt of a metal belonging to group Ia or IIa of the Periodic Table are included in at least one layer of the photographic material.

DETAILED DESCRIPTION OF THE INVENTION

Formula (I) is described in detail below.

In formula (I), $R_1$ represents a hydrogen atom, an alkyl group which has from 1 to 8 carbon atoms, a halogen atom (for example, chlorine, bromine), or a cyano group, and $R_1$ is preferably a hydrogen atom, an alkyl group which has from 1 to 3 carbon atoms (for example, methyl, ethyl), a chlorine atom or a cyano group.

$R_2$, $R_3$ and $R_4$ may be the same or different, preferably each represents an alkylene group which has from 1 to 4 carbon atoms, and they are particularly preferably ethylene groups or

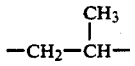

groups.

$R_5$ represents a hydrogen atom, an alkyl group, an alkenyl group, an aryl group or an aralkyl group, having a total carbon number of from 1 to 12, a —CO—$R_9$ group or an —$SO_2R_9$ group. The alkyl, alkenyl, aryl and aralkyl groups for R5 may have substituent groups, and examples of substituent groups for the alkyl and alkenyl groups include halogen atoms, cyano groups, sulfo groups, hydroxyl groups, carboxyl groups, alkyl groups, aryl groups, aralkyl groups, acyloxy groups, acylamino groups, amino groups, sulfonamide groups, alkoxy groups, aryloxy groups, alkylthio groups, arylthio groups, carbamoyl groups, sulfamoyl groups, alkoxycarbonyl groups, aryloxycarbonyl groups, alkylsulfonyl groups, arylsulfonyl groups, alkoxysulfonyl groups, aryloxysulfonyl groups, carbamoylamino groups, sulfamoylamino groups, carbamoyloxy groups, alkoxycarbonylamino groups and aryloxycarbonylamino groups.

Examples of substituent groups for the aralkylene groups and arylene groups include alkyl groups which have from 1 to 20 carbon atoms, substituted alkyl groups, halogen atoms (for example, fluorine, chlorine, bromine, iodine), hydroxyl groups, carboxyl groups, sulfo groups, acylamino groups (for example, acetamide, benzamide), sulfonamide groups, carbamoyl groups, acyloxy groups, alkoxycarbonyl groups, acyl groups, alkoxy groups (for example, methoxy), aromatic oxy groups (for example, phenoxy), nitro groups, formyl groups, and aliphatic and aromatic sulfonyl groups. Groups which can be substituted for the above mentioned alkyl groups for the aralkylene groups and arylene groups include, for example, alkoxy groups, aryloxy groups, alkoxycarbonyl groups, acylamino groups, carbamoyl groups, acyloxy groups, acyl groups, aliphatic oxy groups, aromatic oxy groups and nitro groups, and the aralkylene and arylene groups may have a plurality of these substituent groups.

$R_9$ represents an alkyl group, an alkenyl group, an aryl group or an aralkyl group, having a total carbon number of from 1 to 12, and $R_9$ may have substituent groups. Examples of substituent groups which can be used in $R_9$ include those which have been cited as examples of substituent groups for $R_5$.

The group represented by $R_5$ is preferably an alkyl group, an alkenyl group, an aryl group which may have substituent group and have a total carbon number of from 1 to 8, or a $—COR_9$ group (where $R_9$ represents an alkyl group which may have substituent groups and which has from 1 to 8 carbon atoms, or an aryl group), and $R_5$ may also be, for example, a hydrogen atom, a methyl group, an ethyl group, a hexyl group, a methoxymethyl group, a $—CH_2CF_3$ group, an allyl group, a phenyl group, an acetyl group o a propionyl group.

$R_6$, $R_7$ and $R_8$ represent hydrogen atoms, alkyl groups or alkenyl groups which may be substituted and which have from 1 to 6 carbon atoms. Examples of substituent groups for the alkyl and alkenyl groups include the substituent groups cited as substituent groups for $R_5$. $R_6$, $R_7$ and $R_8$ are preferably hydrogen atoms or alkyl groups which have from 1 to 6 carbon atoms and which may have substituent groups.

X represents —CO—, —COO—, $$-\overset{\overset{R_7}{|}}{C}ON-,$$

—OCO— or an arylene group. The arylene groups preferably have from 6 to 12 carbon atoms.

The groups represented by L are alkylene groups, aralkylene groups or arylene groups, and all these groups may have substituent groups and have from 1 to 12 carbon atoms. Examples of substituent groups for the alkylene groups include those cited as substituent groups for $R_5$. Furthermore, arylene groups and alkylene groups which may have substituent groups and which have from 1 to 8 carbon atoms are preferred for the groups represented by L.

Y represents —CO—, $—SO_2—$ or —NHCO—.

Z represents —O—, —S— or $$-\overset{\overset{R_8}{|}}{N}-.$$

Moreover, m and p each independently represents 0 or 1, provided that m equals 1 when X is $$-CO-\overset{\overset{R_7}{|}}{N}-.$$

Moreover, a, b and c are each integers of value from 0 to 30, and preferably of value from 0 to 25. Furthermore, a, b and c cannot all have a value of 0.

A plurality of different compounds which can be represented by formula (I) ma be used conjointly in the present invention.

Illustrative compounds which can be represented by formula (I) of the present invention are indicated below, but the compounds are not limited by these illustrative examples.

$$CH_2=\underset{\underset{CO_2(CH_2CH_2O)_{14}CH_3}{|}}{CH}$$ (C-1)

$$CH_2=\underset{\underset{CO_2(CH_2CH_2O)_{17}CH_3}{|}}{CH}$$ (C-2)

$$CH_2=\overset{\overset{CH_3}{|}}{\underset{\underset{CO_2(CH_2CH_2O)_{14}CH_3}{|}}{C}}$$ (C-3)

$$CH_2=\overset{\overset{CH_3}{|}}{\underset{\underset{CO_2(CH_2CH_2O)_{19}CH_3}{|}}{C}}$$ (C-4)

$$CH_2=\overset{\overset{CH_3}{|}}{\underset{\underset{CO_2(CH_2CH_2O)_{16}CH_3}{|}}{C}}$$ (C-5)

$$CH_2=\overset{\overset{CH_3}{|}}{\underset{\underset{CO_2(CH_2CH_2O)_{23}CH_3}{|}}{C}}$$ (C-6)

$$CH_2=\underset{\underset{CO_2(CH_2CH_2O)_{13}CH_3}{|}}{CH}$$ (C-7)

$$CH_2=\overset{\overset{CH_3}{|}}{\underset{\underset{CO_2(CH_2CH_2O)_{13}CH_3}{|}}{C}}$$ (C-8)

$$CH_2=\underset{\underset{CO_2(CH_2CH_2O)_{19}CH_3}{|}}{CH}$$ (C-9)

$$CH_2=\underset{\underset{CO_2CH_2CH_2NHCO_2(CH_2CH_2O)_{14}CH_3}{|}}{CH}$$ (C-10)

$$CH_2=\overset{\overset{CH_3}{|}}{\underset{\underset{CO_2CH_2CH_2NHCO_2(CH_2CH_2O)_{19}CH_3}{|}}{C}}$$ (C-11)

$$CH_2=\overset{\overset{CH_3}{|}}{\underset{\underset{CONH-CH_2CH_2-O(CH_2CH_2O)_{17}CH_3}{|}}{C}}$$ (C-12)

-continued (C-13)

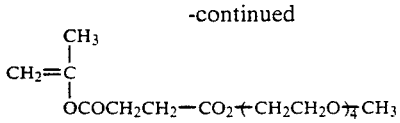

(C-14)

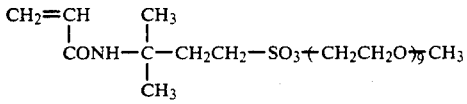

(C-15)

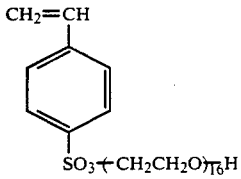

(C-16)

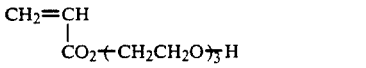

(C-17)

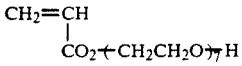

(C-18)

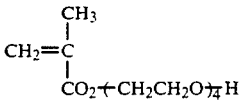

(C-19)

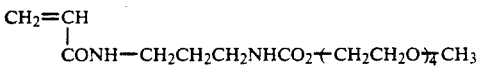

(C-20)

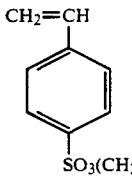

(C-21)

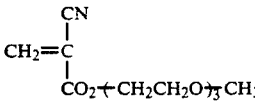

(C-22)

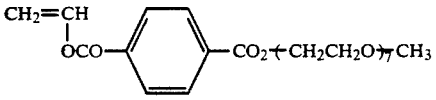

(C-23)

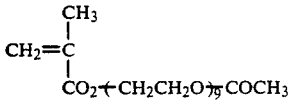

(C-24)

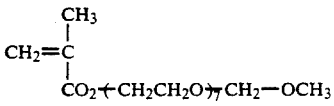

(C-25)

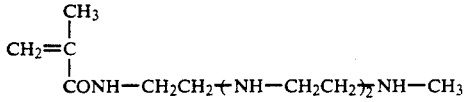

In the present invention, the compound represented by formula (I) can be formed into a film together with the salt of a metal ion belonging to group Ia or group IIa of the Periodic Table after polymerization of the compound. Alternatively, the compound represented by formula (I) can be polymerized for use after film formation. A method in which the compound is polymerized for use after film formation is preferred. Polymerization of the compound represented by formula (I) together with the salt of a metal ion belonging to group Ia or Group IIa of the Periodic Table is preferred when polymerizing after film formation since this enables the antistatic effect to be enhanced.

In the present invention, the antistatic performance can be improved by adding a compound represented by formula (II) when polymerizing the compound represented by formula (I) after film formation.

Formula (II) is represented by the formula shown below.

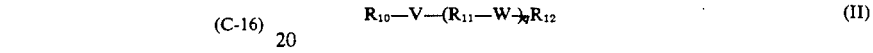

$$R_{10}-V-(R_{11}-W-)_qR_{12} \quad (II)$$

wherein $R_{10}$ and $R_{12}$ each represents a hydrogen atom or an alkyl group which may have substituent groups, and examples of the substituent groups include those cited as substituent groups for $R_5$ above. Hydrogen atoms or alkyl groups which have from 1 to 3 carbon atoms are preferred for $R_{10}$ and $R_{12}$. $R_{11}$ has the same significance as $R_2$. V and W may be the same or different, each representing —O—, —S— or

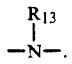

$R_{13}$ represents a hydrogen atom, an alkenyl group or an alkyl group which may be substituted and which has from 1 to 6 carbon atoms. Examples of substituent groups for the alkyl groups and alkenyl groups include those cited as substituent groups for $R_5$. The hydrogen atom and alkyl groups which may be substituted and which have from 1 to 6 carbon atoms are preferred for $R_{13}$.

Moreover, q is an integer of value from 1 to 30 and preferably of value from 2 to 10.

The compounds represented by formula (II) are used generally in an amount of from 20 to 200 mol % and preferably in an amount of from 50 to 100 mol % based on the compound represented by formula (I).

Illustrative compounds which can be represented by formula (II) are indicated below, but these compounds are not limited to these examples.

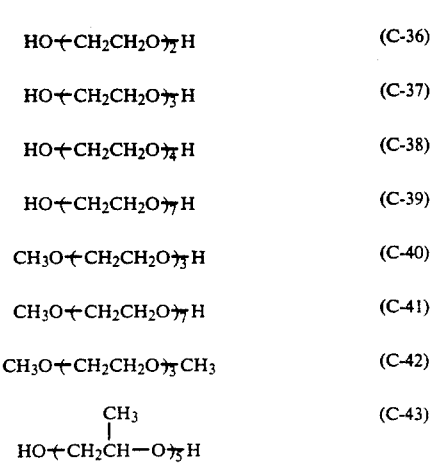

(C-36) $HO\leftarrow CH_2CH_2O\rightarrow_2H$ (C-37) $HO\leftarrow CH_2CH_2O\rightarrow_3H$ (C-38) $HO\leftarrow CH_2CH_2O\rightarrow_4H$ (C-39) $HO\leftarrow CH_2CH_2O\rightarrow_7H$ (C-40) $CH_3O\leftarrow CH_2CH_2O\rightarrow_3H$ (C-41) $CH_3O\leftarrow CH_2CH_2O\rightarrow_7H$ (C-42) $CH_3O\leftarrow CH_2CH_2O\rightarrow_3CH_3$ (C-43) $HO\leftarrow CH_2CH(CH_3)-O\rightarrow_5H$ -continued $$CH_3O(CH_2CH_2O)_7CH_3 \quad \text{(C-44)}$$

Furthermore, the polymerization can be facilitated when polymerizing a compound of formula (I), or when polymerizing a compound of formula (I) in the presence of a compound represented by formula (II), by the addition of preferably from 0.5 to 50 wt % (more preferably from 0.5 to 25 wt %) of a compound represented by formula (III). This is desirable for improving performance in respect of image unevenness and fixing bath contamination.

Formula (III) is represented by the formula shown below.

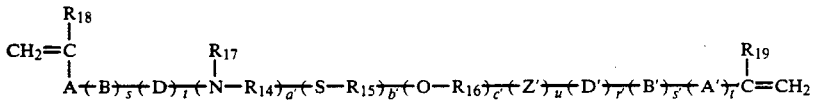

(III)

wherein $R_{14}$, $R_{15}$ and $R_{16}$ have the same significance as $R_2$, $R_3$ and $R_4$, respectively, and $R_{18}$ and $R_{19}$ may be the same or different, each having the same significance as $R_1$. $R_{17}$ has the same significance as $R_6$.

A, B and D have the same significance as X, L and Y, respectively. A', B' and D' also have the same significance as X, L and Y, respectively. Z' has the same significance as Z. Moreover, s, t, u, r', s' and t' are each individually 0 or 1. Moreover, a', b' and c' are each individually integers generally of value from 0 to 30, and preferably of value from 0 to 15.

With the proviso that s is 1 when A is $$-\overset{R_7}{\overset{|}{C}}ON-,$$

and when t' is 1, s' is 1 when A' is $$-\overset{R_7}{\overset{|}{N}}CO-.$$

Examples of compounds which can be represented by formula (III) are indicated below, but of course the compounds are not limited to these examples.

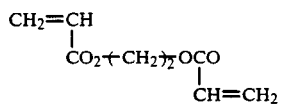

(C-26)

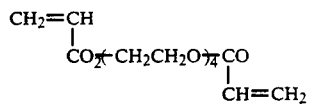

(C-27)

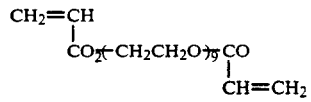

(C-28)

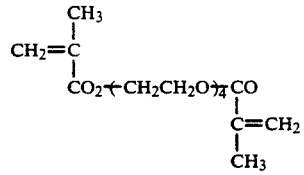

(C-29)

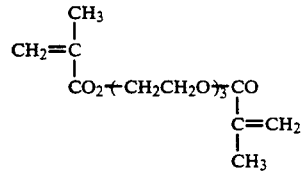

(C-30)

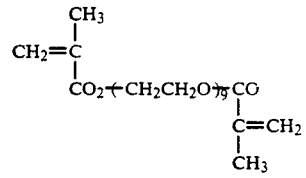

(C-31)

-continued

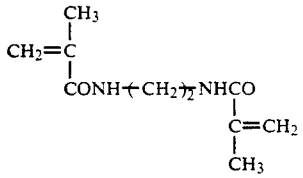

(C-32)

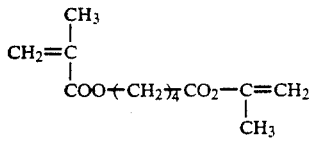

(C-33)

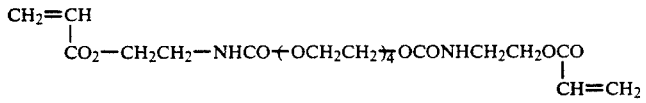

(C-34)

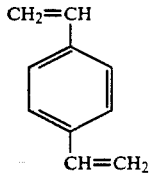

(C-35)

In the present invention, a plurality of different compounds represented by formula (II) and/or (III) may be polymerized when polymerizing the compound represented by formula (I).

Furthermore, copolymerizable monomers other than those represented by formula (III) can be added. Examples of such monomers include acrylic acid, α-chloroacrylic acid, α-alacrylic acids (for example, methacrylic acid), esters and amides derived from these acrylic acids (for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate, vinyl esters (for example, vinyl acetate, vinyl propionate and vinyl laurate), acrylonitrile, methacrylonitrile, aromatic vinyl compounds (for example, styrene and derivatives thereof, such as vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone, N-vinylpyridine and 2- and 4-vinylpyridines. However, the compounds which can be used are not limited to those mentioned above The salts of metal ions belonging to group Ia or IIa of the Periodic Table of the present invention are described below. The metal ion is, for example, a lithium ion, a sodium ion, a calcium ion, a zinc ion or a potassium ion. Preferred examples of the salts of these metal ions are indicated below, but of course the salts are not limited to these examples.

$KCF_3SO_3$, $NaCF_3SO_3$, $LiCF_3SO_3$, $Ca(CF_3SO_3)_2$, $Zn(CF_3SO_3)_2$, $KBF_4$, $NaBF_4$, $LiBF_4$, $KCF_3CO_2$, $NaCF_3CO_2$, $LiCF_3CO_2$, $KC_3F_7CO_2$, $NaC_3F_7CO_2$, $LiC_3F_7CO_2$, $KC_3F_7SO_3$, $NaC_3F_7SO_3$, $KC_4F_9SO_3$, $KPF_6$.

Among these, $KCF_3SO_3$, $NaCF_3SO_3$, $LiCF_3SO_3$, $KBF_4$, $NaBF_4$, $LiBF_4$, $KCF_3CO_2$, $NaCF_3CO_2$, and $LiCF_3CO_2$ are preferred.

Also, two or more of these salts can be used conjointly

The salts of these metal ions are used generally in an amount of from 0.1 mg/m$^2$ to 100 mg/m$^2$, and preferably in an amount of from 1 mg/m$^2$ to 50 mg/m$^2$.

The coated film containing a compound represented by formula (I) can be polymerized by heating or by irradiation with light. The addition of from 0.01 to mol % based on the compound represented by formula (I) of a polymerization initiator is preferred when the polymerization is carried out by heating. Thermal polymerization initiators include azobis compounds, peroxides, hydroperoxides and redox catalysis, and actual examples include potassium persulfate, ammonium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobis-isobutyronitrile and 2,2'-azobis(2-amidinopropane)hydrochloride.

Among these, potassium persulfate, benzoyl peroxide, dicumyl peroxide and azobis-isobutyronitrile are preferred.

Methods of irradiation with active light such as ultraviolet light or visible light, for example, can be used in those cases where the polymerization is carried out by means of irradiation with light. The addition of a photopolymerization initiator is desirable in this case. Examples of photopolymerization initiators include carbonyl compounds, organohalogen compounds, and organic peroxides. Actual examples of such materials include benzoin, 2-methylbenzoin, trimethylsilylbenzoin, 4-methoxybenzophenone, benzoin methyl ether, acetophenone, anthraquinone, 2,2'-dimethoxy-2-phenylacetophenone, trichloromethyl-s-triazine and

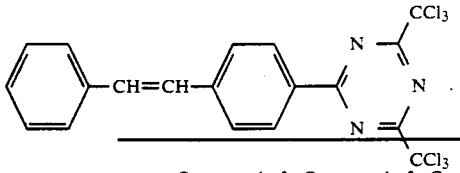

by using the light from an ultrahigh pressure mercury lamp.

Examples of polymers of compounds of the present invention are indicated in the table below, but of course the polymers are not limited to these examples.

| No. | Compound of Formula (I) | Compound of Formula (II) | Compound of Formula (III) | Comonomer | Method of Polymerization (initiator) | Polymerization Conditons |
|---|---|---|---|---|---|---|
| 1 | C-1 (10 g) | — | C-29 (1 g) | — | Thermal (KPS*, 0.1 g) | 4 hr, 80° C. |
| 2 | " | — | C-28 (2 g) | — | " | " |
| 3 | " | C-39 (2 g) | C-29 (1 g) | — | " | " |
| 4 | C-4 (10 g) | — | " | — | Thermal (no initiator) | 8 hr, 100° C. |
| 5 | C-4 (10 g) | — | C-29 (0.5 g) | — | " | " |
| 6 | " | — | C-29 (0.2 g) | — | " | 5 hr, 75° C. |
| 7 | " | — | C-29 (0.5 g) | — | Photo (acetophenone, 0.05 g) | 0.5 hr, 35° C. |
| 8 | C-6 (10 g) | — | C-28 (0.2 g) | " | " | " |
| 9 | " | C-42 (1 g) | C-28 (0.4 g) | — | " | " |
| 10 | " | — | — | — | Thermal (BPO**, 0.2 g) | 3 hr, 80° C. |
| 11 | " | — | — | — | Thermal (no initiator) | 8 hr, 100° C. |
| 12 | " | C-42 (1 g) | — | — | " | " |
| 13 | C-9 (10 g) | — | C-28 (2 g) | — | Thermal (KPS 0.1 g) | 4 hr, 80° C. |
| 14 | " | — | C-34 (2 g) | — | " | " |
| 15 | " | — | C-34 (0.5 g) | — | Thermal (BPO 0.1 g) | " |
| 16 | C-24 (10 g) | — | C-27 (1 g) | — | Photo (benzoin 0.1 g) | 1 hr, 30° C. |
| 17 | C-24 (10 g) | — | C-34 (1 g) | — | Photo (benzoin, 0.1 g) | 1 hr, 30° C. |
| 18 | " | — | C-27 (2 g) | Acrylamide (2 g) | " | " |
| 19 | C-20 (10 g) | — | C-29 (0.5 g) | — | " | " |
| 20 | " | — | C-29 (0.1 g) | — | " | " |
| 21 | C-3 (10 g) | — | C-26 (1 g) | — | Thermal (KPS 0.1 g) | 4 hr, 80° C. |
| 22 | " | C-41 (1 g) | C-30 (0.5 g) | — | " | " |
| 23 | C-7 (10 g) | — | C-26 (1 g) | — | " | " |
| 24 | " | — | C-30 (0.5 g) | — | " | " |

*KPS: Potassium persulfate
**BPO: Benzoyl peroxide

Methods for the polymerization of coated films which contain compounds represented by formula (I) of the present invention are described below.

THERMAL POLYMERIZATION METHOD

The compound represented by formula (I) of the present invention, and a compound represented by formula (II) (this need not be added, depending on the particular case), a compound represented by formula (III) (this need not be added, depending on the particular case), and a comonomer (this need not be added, depending on the particular case), if desired, are dissolved in a suitable solvent, the polymerization initiator as described above is added and, after coating onto a support, the mixture is heated to a temperature of from 40° C. to 100° C. and polymerized.

PHOTOPOLYMERIZATION METHOD

The compound represented by formula (I) of the present invention, and a compound represented by formula (II) (this need not be added depending on the particular case), a compound represented by formula (III) (this need not be added, depending on the particular case) and a comonomer (this need not be added, depending on the particular case), if desired, are dissolved in a suitable solvent, a photopolymerization initiator as described above is added, if desired, and the mixture is coated onto a support. Then, after removing the solvent, for example, by heating, in cases where a solvent has been used for dissolution purposes and its removal is required, the mixture is polymerized by irradiation for the prescribed period of time, for example, The compound represented by formula (I) can be formed int polymers using the known methods of polymerization. For example, they can be dissolved in an appropriate solvent and made to react for a period of from a few minutes to a few hours at 40° to 100° C. using a polymerization initiator.

When using polymers derived from compounds represented by formula (I), the polymer may be dissolved, along with a salt of a metal ion belonging group Ia or group IIa of the Periodic Table in water or an organic solvent such as methanol, ethanol, isopropanol, methyl ethyl ketone or acetone, for example, and then coated on a support.

Polymers derived from compounds which can be represented by formula (I) can be prepared, for example, using the method disclosed on JP-B No. 1-18408.

Compounds represented by formula (I) may be contained in at least one layer such as an emulsion layer or a hydrophilic colloid layer (including a layer formed by a coating solution using a solvent containing water) of the photographic material.

That is, the photographic materials of the present invention are materials in which the layer is obtained by polymerizing a compound represented by formula (I) after being coated, or the layer containing a polymer of a compound represented by formula (I) is preferably used as a backing layer, a surface protective layer, an interlayer or a subbing layer, and more preferably used as a backing layer or a subbing layer, and then the emulsion layer, etc., is coated after the formation of the layer.

Known methods can be used to form the coated film. For example, it can be formed by dip coating, air knife coating, spraying, or by extrusion coating using the hopper disclosed in U.S. Pat. No. 2,681,294, and two or more types of layers may be coated simultaneously using the methods disclosed, for example, in U.S. Pat. Nos. 3,508,947, 2,941,898 and 3,526,528, or methods in which the material is impregnated with an antistatic solution are preferred.

The amount of the compound represented by formula (I) of the present invention used is preferably from 0.0001 g to 2.0 g, and more preferably from 0.0005 g to 0.3 g, per square meter of the photographic material.

The photographic materials of the present invention may be, for example, ordinary black-and-white silver halide photographic materials (for example, camera black-and-white photosensitive materials, X-ray black-and-white photosensitive materials or black-and-white photosensitive materials for printing purposes), ordinary multilayer color photographic materials (for example, color negative films, color reversal films, color positive films, or color negative film for cinematographic purposes), or infrared type sensitive materials for laser scanners. No particular limitation is imposed on the type of silver halide which is used in the silver halide emulsion layers or the surface protective layers of the photographic materials of the present invention. Likewise, no particular limitation is imposed on the method of manufacture, the method of chemical sensitization, or, for example, the antifoggants, stabilizers, film hardening agents, antistatic agents, couplers, plasticizers, lubricants, coating aids, matting agents, brightening agents, spectral sensitizers, dyes and ultraviolet absorbers which are used, and in this connection reference can be made, for example, to *Product Licensing*, Vol. 92, pages 107 to 110 (December, 1971), *Research Disclosure*, Vol. 176, pages 22 to 31 (December, 1978) and ibid., Vol. 238, pages 44 to 46 (1984).

Surfactants can be included in the photographic emulsion layers or other hydrophilic colloid layers of photographic materials made using the present invention for various purposes. For example, surfactants can be used as coating aids or as antistatic agents, for improving slipping properties, for emulsification and dispersion purposes, for the prevention of sticking and for improving photographic properties (for example, accelerating development, increasing contrast or increasing speed).

For example, use can be made of nonionic surfactants, such as saponin (steroid based), alkylene oxide derivatives (for example, polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example, alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinate esters, sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides; and cationic surfactants, such as alkylamine salts, aliphatic or aromatic quaternary ammonium salts, heterocyclic quaternary ammonium salts, for example, pyridinium salts and imidazolium salts, and phosphonium salts and sulfonium salts which contain aliphatic or heterocyclic rings.

These surfactants have been described, for example, in *Surfactants and Their Applications*, by R. Oda (Makishoten, 1964), *New Surfactants* by H. Horiguchi (Sankyo Shuppan Co., 1975) or *McCutcheon's Detergents and Emulsifiers* (McCutcheon Division, MC Publishing Co., 1985), and in JP-A Nos. 60-76741, 62-172343, 62-173459 and 62-215272.

The compounds of the present invention are effective as antistatic agents, but other antistatic agents can be used conjointly to the extent that they supplement the effect of the present invention. Examples of antistatic agents which can be used conjointly in the present invention include in particular the fluorine containing surfactants and polymers thereof disclosed in JP-A Nos. 62-109044 and 62-215272; the nonionic surfactants disclosed, for example, in JP-A Nos. 60-76742, 60-80846, 60-80848, 60-80839, 60-76741, 58-208743, 62-172343, 62-173459 and 62-215272; and the electrically conductive polymers or latexes (nonionic, anionic, cationic, amphoteric) disclosed in JP-A Nos. 57-204540 and 62-215272. Furthermore, ammonium, alkali metal and alkaline earth metal halides, nitrates, perchlorates, sulfates, acetates, phosphates and thiocyanates, and electrically conductive tin oxide, zinc oxide and composite oxides in which these metal oxides have been doped with antimony, for example, as disclosed, for example, in JP-A No. 57-118242, can be used as inorganic antistatic agents. Moreover, various charge transfer complexes, polymers which have conjugated n systems and doped variants thereof, organometallic compounds and interlayer compounds can also be used as antistatic compounds, and examples of such materials include TCNQ/TTF, polyacetylene and polypyrrole. These have been described by Morita et al., in *Kagaku to Kogyo*, 59(3), 103 to 111 (1985) and ibid., 59(4), 146 to 152 (1985).

The use of gelatin is convenient for the binding agent or protective colloid which is used in the emulsion layers and intermediate layers of the photographic materials of the present invention, but other hydrophilic colloids can also be used for this purpose.

For example, gelatin derivatives, graft polymers of other polymers with gelatin and proteins such as albumin and casein, for example; cellulose derivatives such as hydroxyethyl cellulose, carboxymethyl cellulose and cellulose sulfate esters, for example; sugar derivatives such as sodium alginate, dextran, starch derivatives; and many synthetic hydrophilic polymer materials such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, for example, either as homopolymers or as copolymers, can be used.

Acid treated gelatin and enzyme treated gelatin can be used as well as lime treated gelatin, and gelatin hydrolyzates and enzyme degradation products of gelatin can also be used.

From among these materials, the conjoint use of dextran and polyacrylamide with gelatin is preferable.

Polyols, for example, trimethylolpropane, pentanediol, butanediol, ethylene glycol, glycerine and sorbitol, can be used as plasticizers in the hydrophilic colloid layers of photographic materials of the present invention.

The silver halide grains in the photographic emulsions which are used in the photographic materials of the present invention may have a regular crystalline form, such as a cubic or octahedral form, or they may have a crystalline form such as a spherical or plate-like form, or they may have a composite form comprised of these crystalline forms. Moreover, they may be tabular grains as disclosed in *Research Disclosure*, Vol. 225, No. 22534, pages 20 to 58 (November, 1983), JP-A Nos. 58-127921 and 58-113926. Mixtures of grains which have various crystalline forms can also be used.

Metal ions can be added during the formation and/or growth of the silver halide grains, using at least one species selected from among the cadmium salts, zinc salts, lead salts, thallium salts, iridium salts (including complex salts), rhodium salts (including complex salts) and iron salts (including complex salts), and these metal elements may be included within the grains and/or at the grain surface. Also, by placing the silver halide grains in a suitable reducing environment, reduction sensitized nuclei can be provided within the grains or on the surface of the grains.

The unwanted soluble salts may or may not be removed from the silver halide emulsion after the growth of the silver halide grains has been completed. In those cases where the salts are removed, their removal can be accomplished on the basis of the methods described in *Research Disclosure*, No. 17643, Section II (December, 1978).

The silver halide grains may have a uniform silver halide composition throughout or they may be core/-shell grains in which the silver halide compositions of the interior and surface layer are different The silver halide emulsions used may have any grain size distribution. Silver halide emulsions which have a wide grain size distribution (referred to as polydisperse emulsions) may be used and emulsions which have a narrow grain size distribution (referred to as monodisperse emulsions) can be used individually, or a plurality of monodisperse emulsion can be used in the form of a mixture. (Here, a monodisperse emulsion is an emulsion in which the value obtained upon dividing the standard deviation of the grain size distribution by the average grain size is not more than 0.20. In this connection, the grain size is taken to be the diameter of the grain in the case of spherical silver halide grains, or the diameter of a circle of the same area as the projected image of the grain in the case of grains which have a form other than a spherical form.) Furthermore, mixtures of monodisperse emulsions and polydisperse emulsions can also be used.

Furthermore, the emulsions used in the present invention may mix emulsions comprising a photosensitive silver halide emulsion and an internally fogged silver halide emulsion, or a combination of such emulsions used conjointly in separate layers, as disclosed in U.S. Pat. Nos. 2,996,382, 3,397,987 and 3,705,858. Here, the conjoint use of the mercapto compounds disclosed in JP-A No. 61-48832 is desirable for preventing fogging and for improving aging and storage properties.

Various compounds can be included in the photographic emulsions which are used in the present invention with a view to preventing the occurrence of fogging during the manufacture, storage or photographic processing of the photosensitive material, or with a view to stabilizing photographic properties. Thus, many compounds which are known as antifogging agents or stabilizers can be used for this purpose, such as azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzothiazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; thioketo compounds, for example, oxazolinethione; azaindenes, for example, triazaindenes, tetraazaindenes (especially 4-hydroxy substituted (1,3,3a,7)tetraazaindenes) and pentaazaindenes; benzenethiosulfonic acid, benzenesulfinic acid and benzenesulfonic acid amide.

The polymer latexes which are well known in the industry, such as the homopolymers or copolymers of alkyl acrylates and copolymers of vinylidene chloride, can be included in the hydrophilic colloid layers of photographic materials of the present invention. The polymer latex may be prestabilized with nonionic surfactants as disclosed in JP-A No. 61-230136.

Poly(alkylene oxide) or ether, ester or amine derivatives thereof, thioether compounds, thiomorpholines, quaternary ammonium salt compounds, urethane derivatives, urea derivatives, imidazole derivatives and 3-pyrazolidones, for example, may be included in the photographic emulsion layers of photographic materials of the present invention with a view to increasing photographic speed, increasing contrast or accelerating development.

The photographic emulsions used in the present invention may be spectrally sensitized using methine dyes or by other means. The dyes which can be used include cyanine dyes, merocyanine dyes, complex cyanine dyes complex merocyanine dyes, holopolar cyanine dyes, hemicyanine dyes, styryl dyes and hemioxonol dyes. Dyes classified as cyanine dyes, merocyanine dyes and complex cyanine dyes are especially useful in this connection.

AN anihalation layer can be established on the supports which are used in the present invention. Carbon black or various other dyes, for example, oxonol dyes, azo dyes, arylidene dyes, styryl dyes, anthraquinone dyes, merocyanine dyes and tri-(or di-) arylmethane dyes can be used for this purpose. When the dyes are used, a cationic polymer or latex thereof may be used so that the dyes are not diffused from the antihalation layer.

These dyes have been described in *Research Disclosure*, Vol. 176, No. 17643, Section VIII (December, 1978). Furthermore, magenta dyes as disclosed in JP-A No. 61-285445 may be used to improve the tone of the silver image.

So-called matting agents, such as colloidal silica or barium strontium sulfate, poly(methyl methacrylate), methyl methacrylate/methacrylic acid copolymers, the methyl methacrylate/styrenesulfonic acid copolymers disclosed in JP-A No. 63-216046 or the particles which contain fluorine groups disclosed in JP-A No. 61-230136, for example, can be used in the hydrophilic colloid layers used in the present invention.

Inorganic or organic film hardening agents can be included in the photographic emulsion layers and other structural layers of photographic materials of the present invention. For example, use can be made of aldehydes (for example, formaldehyde, glyoxal, glutaraldehyde), active vinyl compounds (for example, 1,3,5-triacryloyl-hexahydro-s-triazine, 1,3-vinylsulfonyl-2-propanol), active halogen compounds (for example, 2,4-dichloro-6-hydroxy-s-triazine) or mucohalogenic acids (for example, mucochloric acid, mucophenoxychloric acid), either individually or in combinations.

Vinylsulfone based compounds, which can be represented by formula shown below, are preferred as film hardening agents.

$$(CH_2{=}CH{-}SO_2{-}CH_2)_2{-}A$$

wherein A represents a divalent group, but it may be omitted.

Developing agents can be included in photographic materials of the present invention. Those disclosed in *Research Disclosure*, Vol 176, page 29 in the section headed "Developing Agents" can be used in the present invention. Particularly, hydroquinone and pyrazolidone are preferably used as developing agents. Couplers which form yellow, cyan and magenta colors, for example, as disclosed in JP-A No. 62-215272, can be used in the present invention.

No particular limitation is imposed upon the method used for coating the layers which constitute the photographic material in the present invention, and conventional coating techniques, for example, such as bar coating, roll coating, knife coating, flow coating (curtain coating), gravure coating, spray coating, dip coating and extrusion coating methods, can be used.

The photographic materials of the present invention can be subjected to development processing of the type which results in the formation of a silver image (black-and-white development), or to development processing of the type which results in the formation of a colored image. In cases where an image is formed by means of a reversal process, a black-and-white image forming process is carried out first, followed by a white light exposure or treatment in a bath which contains a fogging agent, and, finally, a color development process. Furthermore, the silver dye bleaching method can also be used in which dyes are included in the photosensitive material, wherein the exposed material is subjected to a black-and-white development process to form a silver image and the dyes are subsequently bleached using the silver dye bleaching method by use of a bleaching catalyst.

Black-and-white development processing comprises a development process, a fixing process and a water washing process. A stop process may be included after the development process, and in those cases where a stabilizing process is carried out after the fixing process, the water washing process is, in some cases, omitted. Furthermore, developing agents or precursors thereof may be incorporated into the photosensitive material and development processing can then be carried out using only an alkali bath. Development may also be carried out using a lith developer for the development bath.

Color development processing is carried out using a color development process, a bleaching process, a fixing process, a water washing process and, if desired, a stabilizing process. Typically, a bleach-fixing process, in which a single bleach-fixing bath is used, can be used in place of the bleaching process and the fixing process. Also, monobath processes in which a single bath developing, bleaching and fixing process is carried out can also be used.

Film prehardening processes, and neutralizing processes, stop fixing processes and film post-hardening processes can be carried out in combination with these processings. Color developing agents or precursors thereof can be included in the photosensitive material. Activator processing, in which the development processing is carried out in an activator bath, can be used instead of the color development processing in these processing procedures, and activator processing can be applied to monobath processing.

The processing temperature is normally selected within the range from 10° C. to 65° C., but temperatures in excess of 65° C. may be used. Processing is preferably carried out at temperatures of from 25° C. to 45° C.

The conventional black-and-white developing baths can be used for the black-and-white development processing of the black-and-white photographic materials, and the various conventional additives generally added to black-and-white developing baths can be included.

Typical additives include developing agents such as 1-phenyl-3-pyrazolidone, methol and hydroquinone, preservatives such as sulfites, accelerators comprising alkalis such as sodium hydroxide, sodium carbonate and potassium carbonate, inorganic and organic restrainers such as potassium bromide, 2-methylbenzimidazole and methylbenzothiazole, hard water softening agents such as polyphosphates, and surface over development inhibitors such as mercapto compounds and trace amounts of iodide.

Furthermore, with X-ray sensitive materials, the conventional development processing time is shortened. Moreover means are being developed to simplify processing, and the compounds of the present invention provide photographic materials which are excellent for use with the latest processing techniques.

The invention is illustrated below by means of examples, but the invention is not to be construed as limited in any way by these examples.

EXAMPLE 1

(1) Preparation of a Monodisperse Silver Halide Emulsion

The ammonia was introduced into a vessel containing gelatin, potassium bromide and water which had been heated to 55° C. Then, an aqueous solution of silver nitrate and an aqueous solution of potassium bromide, to which a salt of hexachloroiridium(III) acid had been added at a rate such that the mol ratio of iridium with respect to the silver was $1\times10^{-7}$ mol, were added using the double jet method in such a way that the pAg value within the reaction vessel was maintained at 7.60, and monodisperse silver bromide emulsion grains of average grain size 0.55 μm were prepared. The emulsion grains were such that 98% of all the grains were of a size within ±40% of the average grain size. This emulsion was subjected to a desalting process, after which the pH value was adjusted to 6.2 and the pAg value was adjusted to 8.6, and the excellent photographic properties were obtained by carrying out gold sulfur sensitization using sodium thiosulfate and chloroauric acid.

The (100) plane/(111) plane ratio of this emulsion was 98/2 when measured using the Kubelka Munk method. This emulsion is referred to hereinafter as Emulsion A.

Monodisperse Emulsions B and C of average grain size of 0.35 μm and 0.25 μm were prepared by simply reducing the amount of ammonia which was added prior to the formation of the grains in the preparation of Emulsion A.

(2) Preparation of the Emulsion Coating Solution

Emulsions A, B and C (0.333 kg of each) were heated to 40° C. and, after melting, 70 ml of $9\times10^{-4}$ mol/liter methanol solution of an infrared sensitizing dye (structural formula A below), 90 ml of a $4.4\times10^{-3}$ mol/liter aqueous solution of supersensitizer 4,4,-bis[4,6-di(naphthyl-2-oxy)pyrimidin-2-ylamino]stilbene-2,2'-disulfonic acid disodium salt, 35 ml of a $2.8\times10^{-2}$ mol/liter methanol solution of the compound having structural formula B indicated below, an aqueous solution of 4-hydroxy-6-methyl-1,3,3a,7-tetraazaindene, an aqueous solution of the coating aid dodecylbenzenesulfonate and an aqueous solution of the thickener poly(potassium p-styrenesulfonate) were added to provide an emulsion coating solution.

Structural Formula A

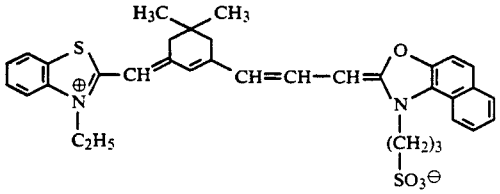

Structural Formula B

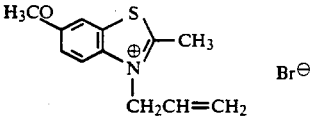

(3) Preparation of Surface Protecting Layer Coating Solution for the Sensitive Layer An aqueous solution of polyacrylamide (molecular weight: 40,000) (0.1 g/m$^2$), an aqueous solution of the thickener poly(sodium styrenesulfonate), matting agent poly(methyl methacrylate) (average particle size: 2.0 μm), film hardening agent N,N'-ethylenebis(vinylsulfonylacetamide), an aqueous solution of coating aid tert-octylphenoxyethoxyethoxyethanesulfonic acid sodium salt (20 mg/m$^2$) and the compounds indicated below were added to a 10 wt % aqueous solution of gelatin (0.9 g/m$^2$), which had been heated to 40° C. to form a coating solution.

| | |
|---|---|
| $C_8F_{17}SO_3K$ | 1 mg/m$^2$ |
| $C_8F_{17}SO_2N(C_3H_7)-(CH_2CH_2O)_5-(CH_2)_4-SO_3Na$ | 1 mg/m$^2$ |

(4) Preparation of the Backing Layer Coating Solution

An aqueous solution of thickener poly(sodium styrenesulfonate), 50 ml of a $5\times10^{-2}$ mol/liter aqueous solution of the dye having structural formula C and an aqueous solution of coating aid sodium tert-octylphenoxyethoxyethoxyethanesulfonate were added to 100 mg/m$^2$ of a 10 wt % aqueous gelatin solution which had been heated to 40° C. Compounds of the present invention as indicated in Table 1 were dissolved in a 1/1 v/v water/methanol mixture (concentration: 2 wt %) and added to and dissolved in the 10 wt % gelatin-containing solution as shown in Samples 1-3 to 1-12 in Table 1, and KPS was added at a rate of 0.5 wt % based on the compound of the present invention as indicated in Table 1 as a polymerization initiator and dissolved in the same solution. A compound of the present invention as indicated in Table 1 was added to Sample 1-2 but no KPS was added in this case. Furthermore, salts of metal ions were added and dissolved in the case of Samples 1-4, 1-6, 1-8, I-10 and 1-12. Moreover, water was added to these solutions to prepare coating solutions in which the gelatin content was 5 wt %. Similarly, with Samples 1-11 and 1-12, compounds of the present invention as indicated in Table 1 were dissolved (concentration: 2 wt %) in a 1/1 v/v water/methanol mixture and then these solutions were added and dissolved in the 10 wt % gelatin-containing solution, and a methanolic solution of acetophenone (concentration: 2 wt %) as a photopolymerization initiator was added at a rate of 0.1 wt % based on the compound of the present invention as indicated in Table 1, and in Sample 1-12 in Table 1, the salt of a metal ion was also added and dissolved in the solution. Moreover, water was added to the solutions to provide coating solutions in which the gelatin content was 5 wt %.

Furthermore, comparative compounds were added to and dissolved in a 10% gelatin solution as shown in Samples 1-13 to 1-17 in Table 1 and coating solutions were prepared by adding water to these solutions so that the gelatin content was 5 wt %.

Samples 1-1 in Table 1 was a control experiment with no additive.

Structural Formula C

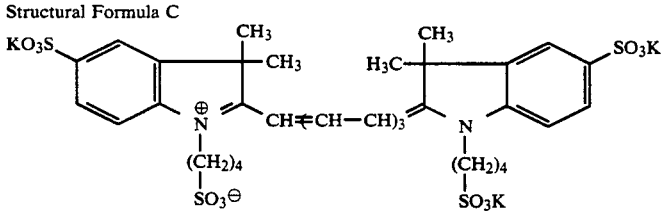

(5) Preparation of Protective Layer Coating Solution for the Backing Layer

An aqueous solution of poly(sodium styrene-sulfonate) (20 mg/m$^2$ as thickener, methyl methacrylate-sodium styrene sulfonate (40 mg/m$^2$) (mol ratio: 97/3) as a matting agent and an aqueous solution of sodium tert-octylphenoxyethoxyethoxyethanesulfonate (20 mg/m$^2$) and an aqueous solution of sodium p-nonylphenoxybutylsulfonate (2 mg/m$^2$) as coating aids were added to a 10 wt % aqueous gelatin solution (1 g/m$^2$) which had been heated to 40° C. to prepare a coating solution.

(6) Preparation of Coated Samples

In the case of Sample 1-2 in Table 1, the aforementioned backing layer coating solution was extrusion coated onto one side of a poly(ethylene terephthalate)

(PET) support to provide a film on the support, and then heated to 120° C. for 4 hours for polymerization. Thereafter, the surface protective layer coating solution was coated on the polymerized film. In the case of Samples 1-3 to 1-10, the coated samples were prepared in the same way as Sample 1-2 except that the thermal polymerization was carried out at 80° C for 4 hours. With Samples 1-11 and 1-12 in Table 1, the aforementioned backing layer coating solution was extrusion coated onto one side of a PET support and dried using a draught, after which photopolymerization was carried out by irradiating the layer for 1 hour with UV light in an irradiation vessel (30° C.) which had been filled with nitrogen, and then the polymerized film was coated with the surface protecting layer coating solution.

With Samples 1-1, and 1-13 to 1-17 in Table 1, the aforementioned backing layer coating solution was extrusion-coated together with surface protective layer coating solution for the backing layer onto one side of a PET support.

Next, the emulsion coating solutions, which contained the infrared sensitizing dye as described in section (2) above in the same discussion of Example 1, and the corresponding coating solution for surface protective layer were coated in such a way as to provide coated silver weights of 3.5 g/m$^2$ on the other sides of these supports. In this case, the coating of the emulsion solution was carried out by extrusion type coating. The sample films so obtained were investigated in respect of static marks caused by urethane or nylon, image unevenness, fixing bath contamination and the number of blemishes in the coating samples using the methods described below.

(7) The composition of the Developing and Fixing Baths Were as Follows:

| | |
|---|---|
| Developing Bath: | |
| Potassium Hydroxide | 17 g |
| Sodium Sulfite | 60 g |
| Diethylenetriaminepentaacetic Acid | 2 g |
| Potassium Carbonate | 5 g |
| Boric Acid | 3 g |
| Hydroquinone | 35 g |
| Diethylene Glycol | 12 g |
| 4-Hydroxyethyl-4-methyl-1-phenyl-3-pyrazolidone | 1.65 g |
| 5-Methylbenzotriazole | 0 6 g |
| Acetic Acid | 1.8 g |
| Potassium Bromide | 2 g |
| Water to make | 1 liter |
| pH adjusted to | 10.50 |
| Fixing Bath: | |
| Ammonium Thiosulfate | 140 g |
| Sodium Sulfite | 15 g |
| Ethylenediaminetetraacetic Acid Disodium Salt Dihydrate | 25 mg |
| Sodium Hydroxide | 6 g |
| Water to make | 1 liter |
| pH adjusted with acetic acid to | 4.95 |

The processing steps were as follows:

| | Processing Temperature (°C.) | Time (seconds) |
|---|---|---|
| Development | 35 | 11.5 |
| Fixing | 35 | 12.5 |
| Water Washing | 20 | 7.5 |
| Drying | 60 | — |
| Dry to Dry Time | — | 60 |

(8) Evaluation of Static Marks

The unexposed samples were adjusted in terms of moisture by standing for 2 hours under conditions of 25° C., 10% RH (Relative Humidity) and then they were rubbed with a urethane rubber roller and a nylon rubber roller in a dark room under the conditions aforementioned. Thereafter, they were developed and processed using the procedure outlined above in section (7) in order to investigate to what extent static marks had been formed with respect to these materials.

The evaluation of static mark formation was made in accordance with the four levels indicated below.

A: No static marks were formed.
B: A few static marks were formed.
C: Quite a lot of static marks were formed.
D: Static marks were formed over almost whole surface.

(9) Evaluation of Image Unevenness

Sample films measuring 25 cm×30 cm were irradiated with infrared light to the extent that the image density after development processing as measured with a Macbeth densitometer was 1.5 and then the films were developed, fixed, washed and dried in the way described above, and the unevenness of the image was evaluated in four levels as indicated below.

A: No image unevenness was observed.
B: Slight image unevenness was observed.
C: Quite a lot of image unevenness was observed.
D: Image unevenness was observed over almost whole surface.

(10) Evaluation of Fixing Bath Contamination

Five hundred samples measuring 25 cm×30 cm which had been exposed with infrared light in such a way as to provide a density on measurement with a Macbeth densitometer of 1.5 were developed and processed using freshly prepared developing and fixing baths. The amount of insoluble material in suspension in the fixing bath at this time was evaluated in the four levels indicated below.

The replenishment rate for the development and fixing baths was 50 ml/film and 60 ml/film, respectively.

A: No suspended matter was observed at all.
B: A small amount of suspended matter was observed.
C: A substantial amount of suspended matter was observed.
D: Very large amounts of suspended matter was observed.

(11) Evaluation of Coating Properties

The evaluation of coating properties was indicated by the number of blemishes on the emulsion layer side per square meter of film. A large numerical value indicated poor coating properties.

TABLE 1

| Sample No. | Compound in the Backing Layer: Compounds of the Present Invention or Comparative Compounds ($mg/m^2$) | Metal Ion ($mg/m^2$) | Static Marks: Urethane | Static Marks: Nylon | Image Unevenness | Fixing Bath Contamination | Coating Properties (number of blemishes) |
|---|---|---|---|---|---|---|---|
| 1-1 (Control) | — | — | D | D | D | A | 1 |
| 1-2 | C-1* (50) | — | B | A-B | A | B-C | 1 |
| 1-3 (Invention) | C-1 (50) | — | B | A-B | A | B | 1 |
| 1-4 (Invention) | C-1 (50) | $CF_3SO_3K$ (5) | A-B | A-B | A | A-B | 2 |
| 1-5 (Invention) | C-1 (50) + C-29 (1) | — | A-B | A | A | A | 1 |
| 1-6 (Invention) | C-1 (50) + C-29 (1) | $CF_3SO_3K$ (5) | A | A | A | A | 2 |
| 1-7 (Invention) | C-1 (50) + C-38 (20) | — | A-B | A | A | B | 1 |
| 1-8 (Invention) | C-1 (50) + C-38 (20) | $CF_3SO_3K$ (5) | A | A | A | B | 2 |
| 1-9 (Invention) | C-1 (50) + C-29 (1) + C-38 (30) | $CF_3SO_3K$ (5) | A | A | A | A | 2 |
| 1-10 (Invention) | C-4 (50) + C-29 (1) | $CF_3SO_3Li$ (5) | A | A | A | A | 2 |
| 1-11 (Invention) | C-9 (50) + C-28 (1) | $CF_3SO_3K$ (5) | B | A | A | A | 1 |
| 1-12 (Invention) | " | $CF_3SO_3Li$ (5) | A | A | A | A | 1 |
| 1-13 (Comparison) | Comparative Compound A (45) | — | A | A | B | D | 2 |
| 1-14 (Comparison) | Comparative Compound B (50) | — | C | C | B | D | 1 |
| 1-15 (Comparison) | Comparative Compound C (50) | — | D | D | B | C | 2 |
| 1-16 (Comparison) | Comparative Compound D (50) | — | B | B | B | C | 5 |
| 1-17 (Comparison) | Comparative Compound E (50) | $CF_3SO_3Li$ (5) | A | B | B | C | 3 |

*No initiator was added

Comparative Compound A $C_{16}H_{33}O-(CH_2CH_2O)_{10}-H$

Comparative Compound B

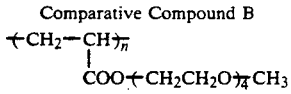

(n: about 50)

Comparative Compound C

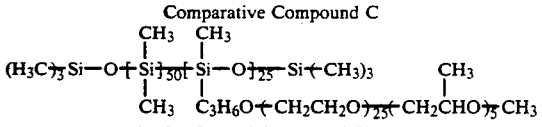

(molecular weight: about 2,500)

Comparative Compound D

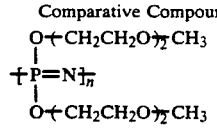

(molecular weight: about $5 \times 10^5$)

Samples 1-2 to 1-12 involving a coated film, in which compounds of the present invention as shown in Table 1 had been polymerized showed a good result in respect of image unevenness and the results obtained in respect of static marks, fixing bath contamination and coating properties were also good. With Samples 1-4 to 1-12, in particular, there was no appearance of static marks and there was no image unevenness or fixing bath contamination, and the coating properties were also good.

On the other hand, Sample 1-1 (the control), which did not contain an compound of the present invention as represented generally by formula (I), was poor in respect of static marks and image unevenness and there were problems with the image. Furthermore, Comparative Samples 1-13 and 1-15 contained nonionic surfactants which had polyoxyethylene groups, but these comparative samples were poor in comparison with Samples 1-3 to 1-12 of the present invention in respect of image unevenness and fixing bath contamination. Moreover, Comparative Samples 1-16 and 1-17 were very poor in respect of image unevenness and fixing bath contamination. Furthermore, Sample 1-14, in which a comparative compound which had not been crosslinked was used, was very poor in respect of fixing bath contamination.

As has been outlined above, the sample films prepared using compounds of the present invention are satisfactory in terms of static marks, image unevenness, fixing bath contamination and coating properties. The present invention clearly provides excellent and superior result in comparison to conventional techniques as is apparent from the results shown by these samples.

EXAMPLE 2

2-1) Emulsion Layer Side Undercoating i) Preparation of methyl methacrylate/ethyl acrylate/acrylic acid copolymer 1.5 g of sodium dodecylnitrate was introduced into a 1 liter three necked flask which had been furnished with an agitator and a reflux condenser and dissolved in 300 ml of water. Next, the reaction vessel was heated to 75° C under nitrogen stream and the solution was agitated at 200 rpm. At this point, 40 g of a 3% aqueous solution of potassium persulfate was added, followed by the dropwise addition over a period of 3 hours of a solution mixture comprising 150 g of methyl methacrylate, 87.5 g of ethyl acrylate and 12.5 g of acrylic acid. A total of six 10 g lots of 3% potassium persulfate solution were added at 30 minutes intervals after the start of the dropwise addition. The reaction vessel was maintained at 75° C. for 2 hours following the completion of the dropwise addition of the monomer mixture and an aqueous dispersion of a copolymer having average molecular weight of 250,000 was obtained. This aqueous dispersion was neutralized with a 10% aqueous potassium hydroxide solution and adjusted to pH 7.0.

ii) Formation of the first emulsion layer side undercoating layer 2,4-Dichloro-6-hydroxy-1,3,5-triazine sodium salt was added to the aforementioned aqueous dispersion of copolymer at the rate of 4 wt % based on the polymer and the first undercoating layer coating solution was obtained by adding fine particles of polystyrene in such a way that fine polystyrene particles having average particle size of 2 μm were coated at the rate of 1.0 $mg/m^2$ at each level.

A biaxially extended poly(ethylene terephthalate) film of thickness 100 μm and width 30 cm was subjected to a corona discharge treatment under the conditions indicated below. The film transporting speed was 30 meters/minute, the gap between the corona discharge electrode and the poly(ethylene terephthalate) film was 1.8 mm and the power was 200 watts. The aqueous dispersion of copolymer prepared using the method outlined above was coated using the bar coater method in such a way as to provide a dry film thickness of 0.1 μm on both surfaces of the poly(ethylene terephthalate) film which had been subjected to the corona discharge treatment and the coated films were dried at 185° C. This layer is referred to hereinafter as the first undercoating layer.

iii) Formation of the second emulsion layer side undercoating layer

The first emulsion layer side undercoating layer formed in ii) above was subjected to a corona discharge treatment at a film transporting rate of 30 meters/minute with a gap between the corona discharge electrode and the film of 1.8 mm and a power of 120 watts and then an aqueous solution of a copolymer of vinylidene chloride, methyl methacrylate, methyl acrylate and acrylonitrile (90/5/4/1) was coated over the top of the film using a gravure coater in such a way as to provide a dry film thickness of 0.4 μm and the coated layer was dried at 120° C.

iv) Formation of the third emulsion layer side undercoating layer

The second undercoating layer formed in the way described above was subjected to a corona discharge treatment at a film transporting rate of 30 meter/minute with a gap between the corona discharge electrode and the poly(ethylene terephthalate) film of 1.8 mm and a power of 250 watts and then the coating solution iv-(a), of which the formulation is indicated below, was coated by extrusion in such a way as to provide 20 ml/m$^2$ over this as a third undercoating layer, and this was dried at 170° C. to form the third emulsion layer side undercoating layer.

| Formulation of the Third Emulsion Layer Side Undercoating Layer Coating Solution iv-(a) | |
|---|---|
| Gelatin | 1.0 wt % |
| Methyl Cellulose | 0.05 wt % |
| $C_{12}H_{25}O—(CH_2CH_2O)_{10}—H$ | 0.03 wt % |
| Water to make | 100 wt % |

The third emulsion layer side undercoating layer was formed in the manner previously described above.

2-2) Backing Layer Side Undercoating i) Formation of the first backing layer side undercoating layer The first backing layer side undercoating layer was provided in the same manner as the first emulsion layer side undercoating layer but on the opposite side of the poly(ethylene terephthalate) film on which the emulsion layer side undercoating layer formed in 2-1) above was formed.

ii) Formation of the second backing layer side undercoating layer

The second backing layer side undercoating layer was formed in the same manner as the second emulsion layer side undercoating layer over the top of the first backing layer side coating layer obtained in the previous section i).

iii) Formation of the third backing layer side undercoating layer

The aforementioned backing layer side undercoating layer was subjected to a corona discharge treatment at a film transporting rate of 30 meters/minute with a gap between the corona discharge electrode and the film of 1.8 mm and a power of 250 watts. Then, the coating solution iii-(a), of which the formulation is shown below, was coated over the top of the film at a rate of 20 ml/m$^2$ Moreover, with Samples 2-2 to 2-5, thermal polymerization was carried out at 80° C. for 4 hours, and with Samples 2-6 and 2-7 polymerization was carried out by irradiation (30° C.) with UV light for a period of 1 hour under nitrogen stream after draught drying, to form the third backing layer side undercoating layer.

| Formulation of the Backing Layer Side Undercoating Layer Coating Solution iii-(a) | |
|---|---|
| * Compound of the present invention or comparative compound was added using the same method as in Example 1 | The concentration was adjusted to the same amount as was added in Example 1 |
| * Thermal polymerization initiator KPS (added to 2-3 to 2-10 in the same way as in Example 1) | Same as above |
| * Photopolymerization initiator (added to 2-11 and 2-12 in the same way as in Example 1) | Same as above |
| * Methanol to make up to | 100 wt % |

2-3) Silver Halide Emulsion Layer Formulation

An aqueous solution of silver nitrate and a mixed aqueous solution of sodium chloride and potassium bromide were added simultaneously at a constant rate over a period of 30 minutes in the presence of $2\times10^{-5}$ mol per mol of silver of rhodium chloride to an aqueous gelatin solution, which was being maintained at 50° C., and a monodisperse silver chlorobromide emulsion having average grain size of 0.2 μm was obtained (Cl content: 95 mol %).

This emulsion was desalted using the flocculation method. Then 1 mg of thiourea dioxide and 0.6 mg of chloroauric acid were added per mol of silver and the emulsion was ripened at 65° C. until the optimum performance was obtained and fogging was limited.

Moreover, the compounds indicated below were also added to the emulsion so obtained.

| | |
|---|---|
| 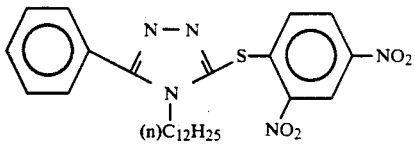 | $2 \times 10^{-2}$ mol/mol Ag |
| 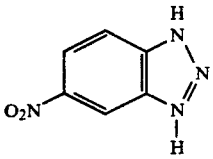 | $1 \times 10^{-3}$ mol/mol Ag |
| 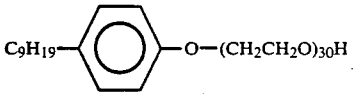 | $4 \times 10^{-4}$ mol/mol Ag |
| KBr | 20 mg/m$^2$ |
| Poly(sodium styrenesulfonate) | 40 mg/m$^2$ |
| 2,4-Dichloro-6-hydroxy-1,3,5-triazine Sodium Salt | 30 mg/m$^2$ |

This coating liquid was coated in such a way as to provide a coated silver weight of 3.5 g/m$^2$.

2-4) Emulsion Protecting Layer Formulation

| | |
|---|---|
| Gelatin | 1.5 g/m$^2$ |
| Fine $SiO_2$ Particles (average particle size: 4 μm) | 50 mg/m$^2$ |
| Sodium Dodecylbenzenesulfonate | 50 mg/m$^2$ |
| 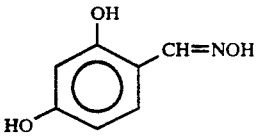 | 20 mg/m$^2$ |
| 5-Nitroindazole | 15 mg/m$^2$ |
| 1,3-Divinylsulfonyl-2-propanol | 50 mg/m$^2$ |
| N-Perfluorooctanesulfonyl-N- | 2 mg/m$^2$ |

-continued

| | |
|---|---|
| propylglycine Potassium Salt | |
| Ethyl Acrylate Latex (average particle size: 0.1 μm) | 300 mg/m$^2$ |
| 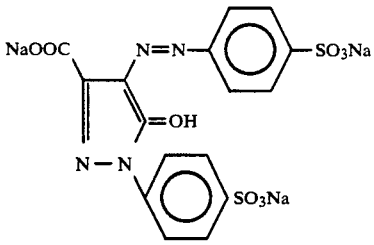 | 100 mg/m$^2$ |

2-5) Backing Layer Formulation

| | |
|---|---|
| Gelatin | 2.5 g/m$^2$ |
| 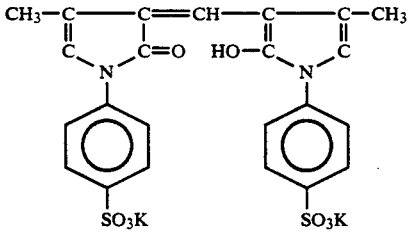 | 30 mg/m$^2$ |
| 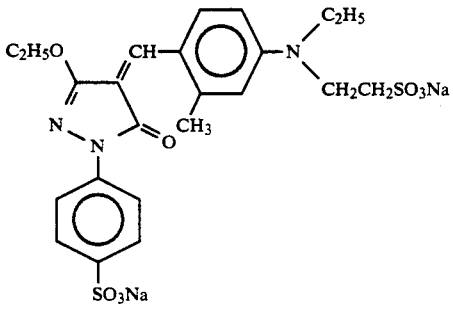 | 140 mg/m$^2$ |

-continued

| | |
|---|---|
| 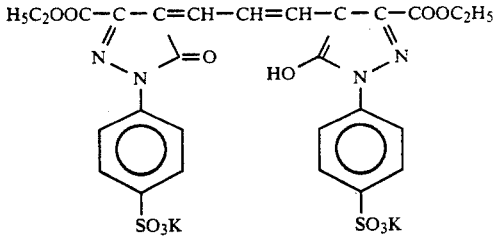 | 40 mg/m$^2$ |
| 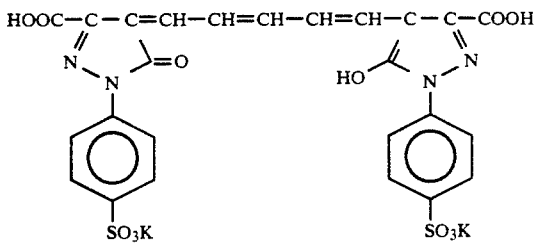 | 80 mg/m$^2$ |
| 1,3-Divinylsulfonyl-2-propanol | 150 mg/m$^2$ |
| Ethyl Acrylate Latex (average particle size: 0.1 μm) | 900 mg/m$^2$ |
| Sodium Dihexyl-α-sulfosuccinate | 35 mg/m$^2$ |
| Sodium Dodecylbenzenesulfonate | 35 mg/m$^2$ |

2-6) Formulation of the Backing Layer Protecting Layer

| | |
|---|---|
| Gelatin | 0.8 g/m$^2$ |
| Fine Poly(methyl methacrylate) Particles (average particle size: 3 μm) | 20 mg/m$^2$ |
| Sodium Dishexyl-α-sulfosuccinate | 10 mg/m$^2$ |
| Sodium Dodecylbenzenesulfonate | 10 mg/m$^2$ |
| Sodium Acetate | 40 mg/m$^2$ |

2-7) Preparation of Sample Film

A silver halide emulsion layer and an emulsion protecting layer were coated sequentially using the extrusion method over the emulsion layer side undercoated layers of the poly(ethylene terephthalate) films which had been undercoated using the methods described earlier. Next, the backing layer and the backing protective layer were coated simultaneously using the extrusion coating method over the backing layer side undercoating layers to provide Samples 2-1 to 2-17.

Development processing was carried out at 38° C. for 20 seconds in an FG-606F automatic processor made by the Fuji Photo Film Co., Ltd. using GR-D1 and GR-F1 for the developer and fixer, respectively, which are made by the same company. The drying temperature at this time was 45° C.

Samples 2-1 to 2-17 obtained in this way were evaluated in the same manner as in Example 1.

Samples 2-2 to 2-12 of the present invention were completely satisfactory in terms of static marks, image unevenness, fixing bath contamination and coating properties, and they also provided excellent images.

On the other hand, Control Sample 2-1 and Comparative Samples 2-13 to 2-17 did not prove to be satisfactory. The excellence and superiority of the present invention in comparison to the conventional technique is clearly shown by these examples.

EXAMPLE 3

3-1) Emulsion Layer Side Undercoating i) Preparation of methyl methacrylate/ethyl acrylate/acrylic acid copolymer 1.5 g of sodium dodecylnitrate was introduced into a 1 liter three necked flask which had been furnished with an agitator and a reflux condenser and dissolved in 300 ml of water. Next, the reaction vessel was heated to 75° C. under nitrogen stream and the solution was agitated at 200 rpm. At this point, 40 g of a 3% aqueous solution of potassium persulfate was added, followed by the dropwise addition over a period of 3 hours of a solution mixture comprising 150 g of methyl methacrylate, 87.5 g of ethyl acrylate and 12.5 g of acrylic acid. A total of six 10 g lots of 3% potassium persulfate solution were added at 30 minute intervals after the start of the dropwise addition. The reaction vessel was maintained at 75° C. for 2 hours following the completion of the dropwise addition of the monomer mixture and an aqueous dispersion of a copolymer having average molecular weight of 250,000 was obtained. This aqueous dispersion was neutralized with a 10% aqueous potassium hydroxide solution and adjusted to pH 7.0.

ii) Formation of the first emulsion layer side undercoating layer 2,4-Dichloro-6-hydroxy-1,3,5-triazine sodium salt was added to the aforementioned aqueous dispersion of copolymer at the rate of 4 wt % based on the polymer and the first undercoating layer coating solution was obtained by adding fine particles of polystyrene in such a way that fine polystyrene particles having average particle size of 2 μm were coated at the rate of 1.0 mg/m$^2$ at each level.

A biaxially extended poly(ethylene terephthalate) film of thickness 100 μm and width 30 cm was subjected to a corona discharge treatment under the conditions indicated below. The film transporting speed was 30 meters/minute, the gap between the corona discharge electrode and the poly(ethylene terephthalate) film was 1.8 mm and the power was 200 watts. The aqueous dispersion of copolymer prepared using the method outlined above was coated using the bar coater method in such a way as to provide a dry film thickness of 0.1 μm on both surfaces of the poly(ethylene terephthalate) film which had been subjected to the corona discharge treatment, and the coated films were dried at 185° C. This layer is referred to hereinafter as the first undercoating layer.

iii) Formation of the second emulsion layer side undercoating layer

The first emulsion layer side undercoating layer formed in ii) above was subjected to a corona discharge treatment at a film transporting rate of 30 meters/minute with a gap between the corona discharge electrode and the film of 1.8 mm and a power of 120 watts. Then, an aqueous solution of a copolymer of vinylidene chloride, methyl methacrylate, methyl acrylate and acrylonitrile (90/5/4/1) was coated over the top of the film using a gravure coater in such a way as to provide a dry film thickness of 0.4 μm and the coated layer was dried at 120° C.

iv) Formation of the third emulsion layer side undercoating layer

The second undercoating layer, formed in the manner described above in iii), was subjected to a corona discharge treatment at a film transporting rate of 30 meters/minute with a gap between the corona discharge electrode and the poly(ethylene terephthalate) film of 1.8 mm and a power of 250 watts. Then, the coating solution iv-(a), of which the formulation is indicated below, was coated by extrusion in such a way as to provide 20 ml/m$^2$ over this as a third undercoating layer, and this was dried at 170° C. to form the third emulsion layer side undercoating layer.

| Formulation of the Third Emulsion Layer Side Undercoating Layer Coating Solution iv-(a) | |
|---|---|
| Gelatin | 1.0 wt % |
| Methyl Cellulose | 0.05 wt % |
| $C_{12}H_{25}O—(CH_2CH_2O)_{10}—H$ | 0.03 wt % |
| Water to make | 100 wt % |

The emulsion layer side undercoating was provided in the way described above.

3-2) Backing Layer Side Undercoating i) Formation of the first backing layer side undercoating layer The first backing layer side undercoating layer was provided in the same manner as the first emulsion layer side undercoating layer, but on the opposite side of the poly(ethylene terephthalate) film on which the emulsion layer side undercoating layer formed in 3-1) above had been formed.

ii) Formation of the second backing layer side undercoating layer

The second backing layer side undercoating layer was formed in the same manner as the second emulsion layer side undercoating layer over the top of the first backing layer side coating layer obtained in the previous section i).

iii) Formation of the third backing layer side undercoating layer

The second backing layer side undercoating layer aforementioned was subjected to a corona discharge treatment at a film transporting rate of 30 meters/minute with a gap between the corona discharge electrode and the film of 1.8 mm and a power of 250 watts and then the coating solution iii-(a), of which the formulation is shown below, was coated over the top of the film at a rate of 20 ml/m$^2$ to form the third backing layer side undercoating layer.

| Formulation of the Backing Layer Side Undercoating Layer Coating Solution iii-(a) | | |
|---|---|---|
| * | Gelatin | 1.0 wt % |
| * | Methyl Cellulose | 0.05 wt % |
| * | $C_{12}H_{25}—O—(CH_2CH_2O)_{10}—H$ | 0.03 wt % |
| * | Compound of the present invention represented by formula (I) as used in the present invention or comparative compound (*1) | The concentration was adjusted in such a manner that the amount added was as shown in Table 2. |
| * | Metal ion belonging to group Ia or IIa of the Periodic Table | The concentration was adjusted in such a manner that the amount added was as shown in Table 2. |
| * | Water to make | 100 wt % |

*1: In the case of materials which were insoluble in water, the material was dissolved in a water/methanol (1/1 by vol) mixture for addition and dispersion.

3-3) Silver Halide Emulsion Layer Formulation

An aqueous solution of silver nitrate and a mixed aqueous solution of sodium chloride and potassium bromide were added simultaneously at a constant rate over a period of 30 minutes in the presence of $2\times10^{-5}$ mol per mol of silver of rhodium chloride to an aqueous gelatin solution, which was being maintained at 50° C., and a monodisperse silver chlorobromide emulsion having average grain size of 0.2 μm was obtained (Cl content: 95 mol%).

This emulsion was desalted using the flocculation method. Then, 1 mg of thiourea dioxide and 0.6 mg of chloroauric acid were added per mol of silver and the emulsion was ripened at 65° C. until the optimum performance was obtained and fogging was limited.

Moreover, the compounds indicated below were also added to the emulsion so obtained.

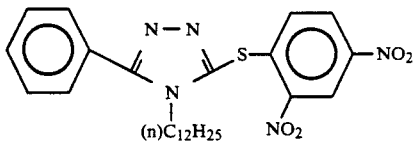

$2\times10^{-2}$ mol/mol Ag

-continued

| | |
|---|---|
| 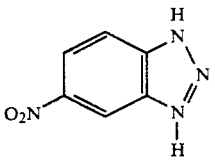 | $1 \times 10^{-3}$ mol/mol Ag |
| 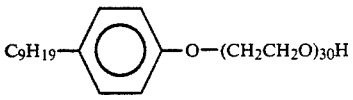 | $4 \times 10^{-4}$ mol/mol Ag |
| KBr | 20 mg/m$^2$ |
| Poly(sodium styrenesulfonate) | 40 mg/m$^2$ |
| 2,4-Dichloro-6-hydroxy-1,3,5-triazine Sodium Salt | 30 mg/m$^2$ |

This emulsion coating liquid was coated in such a way as to provide a coated silver weight of 3.5 g/m$^2$.

3-4) Emulsion Protecting Layer Formulation

| | |
|---|---|
| Gelatin | 1.5 g/m$^2$ |
| Fine $SiO_2$ Particles (average particle size: 4 μm) | 50 mg/m$^2$ |
| Sodium Dodecylbenzenesulfonate | 50 mg/m$^2$ |
| 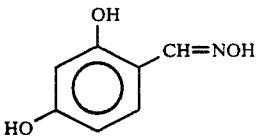 | 20 mg/m$^2$ |
| 5-Nitroindazole | 15 mg/m$^2$ |
| 1,3-Divinylsulfonyl-2-propanol | 50 mg/m$^2$ |
| N-Perfluorooctanesulfonyl-N- | 2 mg/m$^2$ |

-continued

| | |
|---|---|
| propylglycine Potassium Salt | |
| Ethyl Acrylate Latex (average particle size: 0.1 μm) | 300 mg/m$^2$ |
| 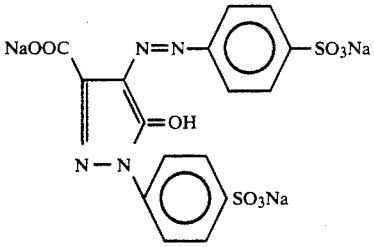 | 100 mg/m$^2$ |

3-5) Backing Layer Formulation

| | |
|---|---|
| Gelatin | 2.5 g/m$^2$ |
| 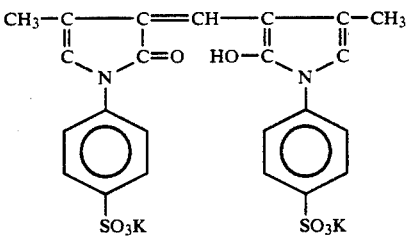 | 30 mg/m$^2$ |
| 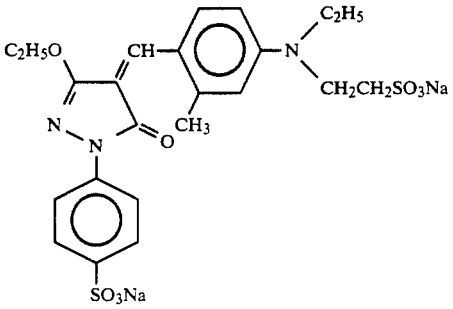 | 140 mg/m$^2$ |

-continued

| | |
|---|---|
| 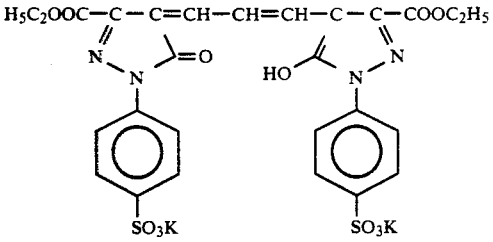 | 40 mg/m$^2$ |
| 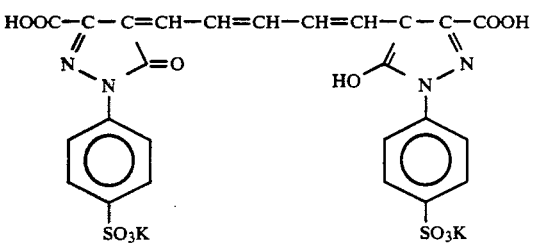 | 80 mg/m$^2$ |
| 1,3-Divinylsulfonyl-2-propanol | 150 mg/m$^2$ |
| Ethyl Acrylate Latex (average particle size: 0.1 μm) | 900 mg/m$^2$ |
| Sodium Dihexyl-α-sulfosuccinate | 35 mg/m$^2$ |
| Sodium Dodecylbenzenesulfonate | 35 mg/m$^2$ |

3-6) Formulation of the Backing Layer Protecting Layer

| | |
|---|---|
| Gelatin | 0.8 g/m$^2$ |
| Fine Poly(methyl methacrylate) Particles (average particle size: 3 μm) | 20 mg/m$^2$ |
| Sodium Dihexyl-α-sulfosuccinate | 10 mg/m$^2$ |
| Sodium Dodecylbenzenesulfonate | 10 mg/m$^2$ |
| Sodium Acetate | 40 mg/m$^2$ |

3-7) Preparation of Sample Films

A silver halide emulsion layer and an emulsion protecting layer were coated sequentially using the extrusion method over the emulsion layer side undercoated layers of the poly(ethylene terephthalate) films which had been undercoated using the methods described earlier. Next, the backing layer and the backing protective layer were coated simultaneously using the extrusion coating method over the backing layer side undercoating layers to provide Samples 3-1 to 3-10.

Development processing was carried out at 38° C. for 20 seconds in an FG-606F automatic processor made by the Fuji Photo Film Co., Ltd. using GR-D1 and GR-F1 for the developer and fixer, respectively, which are made by the same company. The drying temperature at this time was 45° C.

Samples 3-1 to 3-10 obtained were evaluated in the same manner as in Example 1.

TABLE 2

| Sample No. | Compound in the Backing Layer: Compounds of the Present Invention or Comparative Compounds (mg/m$^2$) | Compound in the Backing Layer: Metal Ion (mg/m$^2$) | Static Marks: Urethane | Static Marks: Nylon | Image Unevenness | Fixing Bath Contamination | Coating Properties (number of blemishes) |
|---|---|---|---|---|---|---|---|
| 3-1 (Control) | — | — | D | D | D | A | 1 |
| 3-2 (Invention) | Polymer derived from C-1 (50) | $CF_3SO_3Na$ (5) | B | A-B | A-B | B-C | 1 |
| 3-3 (Invention) | Polymer derived from C-4 (50) | $CF_3SO_3K$ (5) | A-B | B | A | B-C | 1 |
| 3-4 (Invention) | Polymer derived from C-4 (60) | $CF_3SO_3Li$ (5) | B | A-B | A-B | B | 2 |
| 3-5 (Invention) | Polymer derived from C-9 (50) | $KBF_2$ (5) | B | B | A-B | B | 1 |
| 3-6 (Invention) | Polymer derived from C-3 (50) | $CF_3CO_3K$ (5) | B | B | A | B-C | 1 |
| 3-7 (Invention) | Polymer derived from C-12 (50) | $CF_3SO_3Li$ (5) | B | A-B | A-B | B | 1 |
| 3-8 (Invention) | Polymer derived from C-17 (50) | $KBF_4$ (5) | A-B | B | A | B-C | 2 |
| 3-9 (Comparison) | Comparative Compound B (50) | — | C | C | A-B | D | 1 |
| 3-10 (Comparison) | Comparative Compound D (50) | $CF_3SO_3Li$ (5) | A | B | B | C | 3 |

Samples 3-2 to 3-8 of the present invention were completely satisfactory in terms of static marks, image unevenness, fixing bath contamination and coating properties, and they also provided excellent images.

On the other hand, Control Sample 3-1 and Comparative Samples 3-9 and 3-10 did not prove to be satisfactory. The excellence and superiority of the present invention in comparison to conventional techniques is clearly shown by the results of these examples.

By means of the present invention, it is possible to provide a simultaneous improvement in respect of static marks, image unevenness, processing bath contamination and coating properties for photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one photosensitive silver halide emulsion layer, and at least one layer selected from the group consisting of a backing layer or a subbing layer formed by polymerizing a film which contains a compound represented by formula (I):

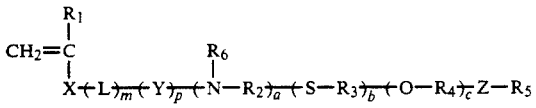

(I)

wherein X represents —CO—, —COO—,

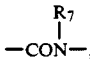

—OCO— or an arylene group; L represents an alkylene group, an aralkylene group or an arylene group, any of which can optionally have substituents; Y represents —CO—, —SO— or —NHCO—; m and p each independently represents 0 or 1, provided that when X is

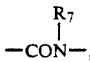

m is 1; Z represents —O—, —S— or

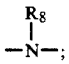

$R_1$ represents a hydrogen atom, an alkyl group, a halogen atom or a cyano group; $R_2$, $R_3$ and $R_4$ represents lower alkylene groups; $R_5$ represents a hydrogen atom, an alkyl group, an alkenyl group, an aryl group, an aralkyl group, —CO—$R_9$ or —$SO_2R_9$—, any of which, other than a hydrogen atom, can optionally have substituents; $R_6$, $R_7$ and $R_8$ represents hydrogen atoms, alkyl groups or alkenyl groups, any of which, other than hydrogen atoms, can optionally have substituents; $R_9$ represents an alkyl group, an alkenyl group, an aryl group or an aralkyl group, any of which can optionally have substituents; and a, b and c each independently represents an integer of value form 0 to 30, and a, b and c are not all equal to 0, wherein said compound represented by formula (I) is polymerized in the presence of a compound represented by formula (III):

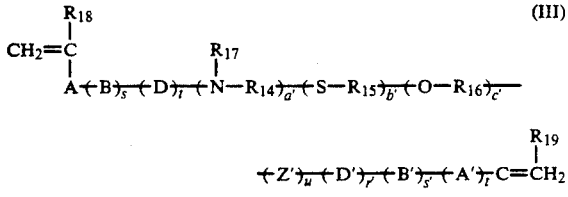

(III)

wherein $R_{14}$, $R_{15}$ and $R_{16}$ have the same significance as $R_2$, $R_3$ and $R_4$, respectively, and $R_{18}$ and $R_{19}$ may be the same or different, each having the same significance as $R_1$; $R_{17}$ has the same significance as $R_6$; A, B and D have the same significance as X, L and Y, respectively; A', B' and D' also have the same significance as X, L and Y, respectively; Z' has the same significance as Z; s, t, u, r', s' and t' are each individually integers of value from 0 to 30, provided that s is 1 when A is

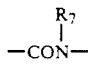

and when t' is 1, s' is 1 when A' is

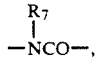

wherein said compounds represented by formulae (I) and (III) are coated onto a support and then polymerized to form said at least one backing layer or subbing layer.

2. The silver halide photographic material as claimed in claim 1, wherein a salt of a metal belonging to group Ia or group IIa of the Periodic Table is included in said at least one backing layer or subbing layer.

3. A silver halide photographic material as claimed in claim 1, wherein a salt of a metal ion belonging to group Ia or group IIa of the Periodic Table is included when polymerizing the compound represented by formula (I).

4. The silver halide photographic material as claimed in claim 1, wherein said compound represented by formula (I) as contained in said at least one backing layer or subbing layer in an amount of from 0.00001 to 2.0 g per square meter of said photographic material.

5. The silver halide photographic material as claimed in claim 2, wherein the salt is used in an amount of from 0.1 mg/$m^2$ to 100 mg/$m^2$ of the photographic material.

6. The silver halide photographic material as claimed in claim 1, wherein said compound represented by formula (III) is used in an amount of from 0.5 to 50 wt %.

7. The silver halide photographic material as claimed in claim 1, wherein said compound represented by formula (I) is contained in an amount of from 50 to 99.5 wt % and said compound represented by formula (III) is contained in an amount of from 0.5 to 50 wt %.

8. A method for preparing a silver halide photographic material comprising a support having thereon at least one photosensitive silver halide emulsion layer, wherein at least one layer of said photographic material is formed by polymerizing a film which contains a compound represented by formula (I):

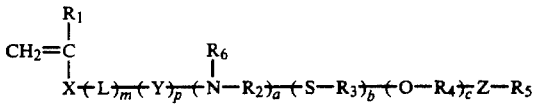

(I)

wherein X represents —CO—, —COO—,

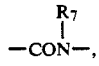

—OCO— or an arylene group; L represents an alkylene group, an aralkylene group or an arylene group, any of which can optionally have substituents; Y represents —CO—, —$SO_2$— or —NHCO—; m and p each independently represents 0 or 1, provided that when X is

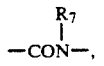

m is 1; Z represents —O—, —S— or $$-\overset{\overset{\displaystyle R_8}{|}}{N}-;$$

$R_1$ represents a hydrogen atom, an alkyl group, a halogen atom or a cyano group; $R_2$, $R_3$ and $R_4$ represent lower alkylene groups; $R_5$ represents a hydrogen atom, an alkyl group, an alkenyl group, an aryl group, an aralkyl group, —CO—$R_9$ or —$SO_2R_9$, any of which, other than a hydrogen atom, can optionally have substituents; $R_6$, $R_7$ and $R_8$ represents hydrogen atoms, alkyl groups or alkenyl groups, any of which, other than hydrogen atoms, can optionally have substituents; and a, b and c each independently represents an integer of value from 0 to 30, and a, b and c are not all equal to 0, wherein said compound represented by formula (I) is polymerized in the presence of a compound represented by formula (III):

$$CH_2{=}\overset{\overset{\displaystyle R_{18}}{|}}{C}\text{—}A\text{—}(B)_s\text{—}(D)_t\text{—}\overset{\overset{\displaystyle R_{17}}{|}}{N}\text{—}R_{14}\text{—}(S\text{—}R_{15})_{a'}\text{—}(O\text{—}R_{16})_{b'}\text{—}(Z')_{c'}\text{—}(D')_{u'}\text{—}(B')_{r'}\text{—}(A')_{s'}\text{—}\overset{\overset{\displaystyle R_{19}}{|}}{C}{=}CH_2$$

wherein $R_{14}$, $R_{15}$ and $R_{16}$ have the same significance as $R_2$, $R_3$ and $R_4$, respectively, and $R_{18}$ and $R_{19}$ may be the same or different, each having the same significance as $R_1$; $R_{17}$ has the same significance as $R_6$; A, B and D have the same significance as X, L and Y, respectively; A', B' and D' also have the same significance as X, L and Y, respectively; Z' has the same significance as Z; s, t, u, r', s' and t' are each individually 0 to 1; and a', b' and c' are each individually integers of value from 0 to 30, provided that s is 1 when A is $$-\overset{\overset{\displaystyle R_7}{|}}{CON}-$$

and when t' is 1, s' is 1 when A' is $$-\overset{\overset{\displaystyle R_7}{|}}{NCO}-.$$

* * * * *